US005992112A

United States Patent [19]

Josey

[11] Patent Number: 5,992,112

[45] Date of Patent: Nov. 30, 1999

[54] MODULAR BUILDING FLOOR STRUCTURE

[75] Inventor: Gary L. Josey, Wilmington, N.C.

[73] Assignee: Josey Industrial Technologies, Inc., Wilmington, N.C.

[21] Appl. No.: 08/704,230

[22] Filed: Aug. 27, 1996

[51] Int. Cl.[6] ..... E04C 1/00

[52] U.S. Cl. ..... 52/309.8; 52/783.11

[58] Field of Search ..... 52/309.8, 783.1, 52/783.11, 783.17, 783.19, 784.14, 784.15, 793.1, 798.1, 800.1, 802.1, 309.5; 428/73

[56] References Cited

U.S. PATENT DOCUMENTS

| | | | |
|---|---|---|---|
| 2,849,758 | 9/1958 | Plumley et al. | 52/238.1 X |
| 2,863,185 | 12/1958 | Reidi . | |
| 2,893,076 | 7/1959 | Herts . | |
| 2,907,417 | 10/1959 | Doerr | 52/238.1 X |
| 2,999,278 | 9/1961 | Spencer et al. . | |
| 3,203,145 | 8/1965 | Raynes . | |
| 3,235,920 | 2/1966 | Davis . | |
| 3,302,361 | 2/1967 | Oudheusden et al. | 52/238.1 X |
| 3,434,262 | 3/1969 | Lawrence . | |
| 4,014,143 | 3/1977 | Purcell . | |
| 4,069,636 | 1/1978 | Kessler . | |
| 4,076,877 | 2/1978 | Tanzen . | |
| 4,180,952 | 1/1980 | Vanderlyn . | |
| 4,186,535 | 2/1980 | Morton | 52/238.1 X |
| 4,272,933 | 6/1981 | Lopes . | |
| 4,599,841 | 7/1986 | Haid . | |
| 4,603,531 | 8/1986 | Nash . | |
| 4,833,854 | 5/1989 | Paul . | |
| 4,931,340 | 6/1990 | Baba et al. . | |
| 4,937,125 | 6/1990 | Sanmartin et al. . | |
| 4,972,635 | 11/1990 | Wageman | 52/94 |
| 4,973,506 | 11/1990 | Bauer et al. . | |
| 4,981,735 | 1/1991 | Rickson . | |
| 5,006,391 | 4/1991 | Biersach . | |
| 5,014,476 | 5/1991 | Leslie et al. . | |
| 5,052,164 | 10/1991 | Sandow | 52/309.1 X |
| 5,058,352 | 10/1991 | Loiselle et al. . | |
| 5,062,250 | 11/1991 | Buzzella . | |
| 5,085,023 | 2/1992 | Duffy . | |
| 5,357,722 | 10/1994 | Kessler . | |
| 5,377,470 | 1/1995 | Hebinck . | |
| 5,390,468 | 2/1995 | Probst . | |
| 5,442,890 | 8/1995 | Fligg . | |

*Primary Examiner*—Beth Aubrey
*Attorney, Agent, or Firm*—Rhodes & Mason, PLLC

[57] ABSTRACT

A floor structure for a manufactured building is formed of a steel I-beam frame having a horizontal upper surface to which is secured a plurality of adjacent composite floor panels. Each panel is formed of a resin impregnated, kraft paper, honeycomb core or inner section having opposed faces and a continuous outer periphery; a wooden frame about the periphery of the honeycomb core; and full hard steel skins secured to opposite sides of the frame and across opposed faces of the honeycomb core. The floor structure can further polyurethane foam insulation panels spaced beneath, and parallel to, the floor panels, and supported by brackets attached to the steel frame and to floor panels, brackets to secure the structure to ground anchors, and conductive tape to ground the panel surfaces.

26 Claims, 3 Drawing Sheets

MODULAR BUILDING FLOOR STRUCTURE

BACKGROUND OF THE INVENTION (1) Field of the Invention

The present invention relates generally to improvements in the construction of manufactured buildings, e.g., modular or mobile homes. The invention relates in particular to a floor structures for such buildings, and to composite structural panels used to construct these floor structures, as well as to other components used as a part of the floor structures.

(2) Description of the Prior Art

Modular buildings, also known as manufactured buildings, are constructed at least in part at a remote site. The entire building can be constructed at the production facility, and then moved to a permanent location where the building is positioned on a foundation. In other instances, components of the building, e.g. wall, floor or ceiling components, are manufactured at the remote site, and assembled at the final destination. This type of construction is widely used to construct residential buildings, commonly known as a mobile homes, or manufactured housing, as well as in other residential and commercial structures.

Manufactured building are comprised of a supporting floor structure adapted to be positioned on a foundation, or on a wheeled support. This floor structure supports walls and other components of a building, which may be constructed of prefabricated panels. Insulation, an outer covering, and utilities, are then added to complete the building structure. In the case of mobile homes in particular, tie-downs are also used to anchor the building.

The floor structure conventionally used prior to the present invention is composed of oriented strand board over 2×6 southern white pine, and suffers from several deficiencies. Of major concern is the fact that connecting points of the building can be loosened by flexing of the floor structure during transport of the building, or during severe adverse weather conditions, resulting in weakening or even collapse of the building. A conventional floor structure is also easily subject to damage from fire or water.

SUMMARY OF THE INVENTION

The present invention is directed to a building floor structure, and to components thereof, that overcomes deficiencies of prior art floor structures. A particular aspect of the invention is to provide a floor structure for manufactured or mobile homes or other buildings that is resistant to significant flexing experienced with prior art structures, and which is resistant to fire and water.

Another aspect of the invention is to provide a composite panel for use in a floor structure, as well as for other structural uses. Still other objectives of the present invention relate to building components that can be used with the floor structure.

In general, the housing base or floor structure of the invention is comprised of a chassis, or support frame, preferably constructed of steel bars or beams, having planar upper surfaces lying in a horizontal plane when free of a load, forming a panel attachment surface, and a plurality of adjacent, composite, structural floor panels secured to the upper surface of the chassis, and to each other. The beams may be of different cross-sectional configurations, e.g. I-beams, square tubes, or a combination of cross-sectional shapes.

The floor may also include a plurality of insulation panels supported beneath, and parallel to, the floor panels, with an air space separating the insulation panels and the floor panels. Insulation panel supports may be secured to the chassis and/or the lower surface of the floor panels to support the insulation panels. The floor may also include other components, such as keys or splines between facing edges of floor panels to increase rigidity, conductive tape joining the floor panels to ground all panels, and tie down brackets to secure the floor to the ground.

The composite floor panel is comprised of a honeycomb core or insert, a frame or closeout surrounding the periphery of the honeycomb core, and skins across the opposed faces of the honeycomb core. The honeycomb core is generally of a rectangular configuration, although some sections may be of other shapes, e.g., triangular, if needed to form sections of a floor of a particular design.

While the holes in the honeycomb core will ordinarily be of a hexagonal cross-section, it should be understood that the term "honeycomb," as used herein, is intended to encompass cores formed with holes of other cross-sectional shapes, e.g., triangular, rectangular, or parabolic. Hexagonal holes will have a cross-sectional length of from about three-eights to about one inch, and a cross-sectional width of from about one-fourth to about one-half inch. Preferably, the hexagonal holes will have a length of about one-half inch and a width of about three-eights inch. Other hole shapes will be of approximately an equivalent cross-sectional area.

The honeycomb core may be formed of various materials, e.g., steel, aluminum, plastic or paper. For reasons of cost and weight, the honeycomb core is desirably formed of strips of kraft paper with discrete areas joined to adjacent strips to form a plurality of openings or holes when the core is expanded. The kraft paper best suited for manufacture of the core is linerboard or saturating type kraft paper derived from southern grown farm pines, processed into pulp with a long fiber grain specifically oriented for optimum strength. In order to achieve the desired strength, the kraft paper should be at least 18#, and preferably 33 to 42# paper.

Moisture resistance and strength are increased by impregnating the paper with up to about 38% by weight of a resin, normally a water or other solvent based resin, such as a low-emission, waterborne phenolic resin of the type sold by Georgia-Pacific Resins, Inc., Decatur, Georgia as item number GP 413D97.

For most applications, the panel will be from about 1 to about 20 feet in length, from about 1 to about 5 feet in width, and from about 1 to about 6 inches in thickness. In order to standardize the product, and conform to the dimensions of other components of the structure, the panels will normally be manufactured in widths that are multiples of 1 foot. A standard length to meet the needs of most modular housing construction will be 14 feet.

The honeycomb insert panel or core is surrounded by a frame having an inner opening with an inner periphery corresponding to the outer periphery of the honeycomb core, so that the honeycomb core fits snugly into the frame opening. Normally, the frame will be rectangular, with spaced, parallel side members, having their ends joined to the ends of spaced, parallel end members. The frame members are preferable formed of wood, and even more preferably, are formed of a composite wood product. Such a product is described as "Engineered Strand Lumber" or "Parallel Stand Lumber." These composite wood products are made from long, thin strands of wood that are bonded under heat and pressure. Composite wood products are preferred because they are straighter and stronger than solid sawn lumber, and use raw materials more efficiently.

Each frame member will ordinarily have a rectangular cross-section, with a height or thickness corresponding to the thickness of the honeycomb core, and a width or horizontal dimension, of from about 1 to about 6 inches. The side members will have a length equal to the length of the honeycomb core, plus the width of the end members, and the end members will have a length equal to the width of the honeycomb core, thereby forming an interior opening corresponding to the outer dimensions of the honeycomb panel. Alternatively, the ends of the end members can extend over the ends of the side members. In this case, end members will have a length equal to the width of the honeycomb panel, plus the width of the side members, and side members will have a length equal to the length of the honeycomb core.

The skins of the honeycomb core are uniquely formed of full hard steel, i.e., steel that has not been annealed. Existing floor panels for manufactured structures are normally formed of wood, which flexes under stress, which can result in damage to the panels and separation of component joints. Full hard steel is essentially unbendable, and is ideally suited for the purposes of the present invention, in that flexing of the structure is largely prevented, particularly when floor panels having skins of full hard steel are secured to the chassis described above to form an integral structure.

Preferably, each skin is rectangular, with dimensions equal to the outer dimensions of the panel framework, thereby entirely covering, the surface of the panel. The thickness of the panel will normally be from about 1 to 4 inches, depending upon the structure in which the panel is used. The steel skins may be galvanized to reduce rusting, and can be acid etched to enhance adhesive bonding.

In forming the composite panel, the ends of the end and side sections of the panel frame are joined with an adhesive and/or fasteners. The honeycomb core is then inserted into the interior opening of the frame. One of the skins can be joined to a side of the frame before insertion of the honeycomb core, or both skins can be secured to the frame after the honeycomb core is in place. A preferred way to secure the skins is with an adhesive, such as a water-based, urethane adhesive, which is coated onto the faces of the honeycomb core and frame.

The chassis is formed of a plurality of steel sections, together forming a horizontal surface to which the floor panels and other components of the structure are joined. Normally, the steel sections will be of a I-beam configuration, with the central part on the "I" being in a vertical position. The upper part of the "I" forms a horizontal surface or flange having a width of from about 2 to about 6, e.g., 4 inches, while the lower part of the "I" forms a corresponding, parallel lower horizontal surface. The length of the vertical central section, and thus the spacing between the upper and lower end sections or parts of the beam will be from about 4 to about 12 inches, e.g., 10 inches. Other beam shapes, e.g., square tube or channel steel, can be used to form all or a part of the chassis.

While steel beams have been used previously to form the chassis of structures of the kind contemplated by the present invention, the side beams of prior art structure have been cambered or curved upwardly at their center when not under a load, so that the flexing of the beam when under load, brings the upper surfaces of the side sections into a horizontal plane. In the present invention, however, the upper surface of all sections lie in a horizontal plane when not under load. The steel beams are preferably formed of ASTM A546 Gr. 50 to Gr. 60 steel.

The dimensions of the chassis will be determined by the dimensions of the floor to be constructed. In most instances, the length of the chassis will be from about 30 to about 80 feet, and the width of the chassis will be from about 10 to about 20 feet. The dimensions of the chassis will be such that the chassis surface will be covered by a plurality of adjacent floor panels positioned transverse to the chassis direction. The chassis width will normally be equal to the panel length, and the chassis length will normally be a multiple of the panel width.

The panels may be secured to the upper surface of the chassis by various methods which will be familiar to one skilled in the art, e.g., welding, clips, studs, or VHB adhesive tape. A desirable adhesive is a epoxy adhesive. In applying the adhesive, the steel chassis surface and the adjacent skin surface are scaled and wiped with alcohol prior to application of the adhesive.

The adjacent or abutting edges of the floor panels are also secured to each other with an adhesive. However, since there will be some expansion and contraction of the wood components of the panels, a flexible adhesive is used in this application, so that the expansion and contraction can occur without affecting the steel skins. The adhesive should have a strength in three directions of at least 80 psi. A suitable adhesive is sold under the trademark CX-80 by Chemrex Corporation, Shakopee, Minnesota. Alternatively, the adjacent surfaces of the panels can be joined using a double-sided industrial adhesive tape, such as an acrylic, very high bond (VHB), tape manufactured by the 3M Company, St. Paul, Minn. The adhesive or tape is used to join adjacent faces of abutting wood frames.

Rigidity of the structure is improved by also inserting a spline or key between adjacent panels. For this purpose, longitudinal grooves or slots are cut or routed into faces of the frame equi-distant between the steel skins. A spline or key is then inserted into facing slots of adjacent frames. These slots then form a channel when panels are positioned with faces of adjacent panels abutting. Preferably the spline is formed of cold rolled steel having a thickness of from about 0.125 to about 0.250 inch, and a width of from about 0.75 to about 1 inch. The depth and width of each slot is preferably about one-sixteenth inch greater than the corresponding key dimensions to allow for expansion. The length of the key can be up to approximately the length of the slotted panel member, but will not normally be exposed, since the ends will be covered by the end frame members.

The floor structure can also include insulation panels positioned beneath the floor panels. Preferably, the upper surfaces of the insulation panels are parallel to, and spaced about 1 to about 4 inches, e.g., 2 inches, from, the lower surfaces of the floor panels. The resultant air space between the panels not only acts as an insulation barrier, but can also be used to run utility piping, cables, etc., to various parts of the structure. The insulation panels can be constructed of various known materials. For example, the panels may be of rigid polyurethane foam.

Mounting brackets are used to support the insulation panels beneath the floor panels. The brackets may be secured to the chassis, the floor panels, or both. A preferred bracket for attachment to the inner side of a chassis section is comprised of a vertical member having spaced, horizontal members or plates extending inwardly from the upper and lower edges of the vertical member. The distance between the upper and lower plates is approximately equal to the thickness of the insulation panel, e.g., about 1 to about 4 inches.

Each chassis bracket is preferably secured to the inside of the vertical member of a chassis section with double-sided adhesive tape of the type noted above. The chassis bracket can also include a vertical, upwardly extending, retainer plate joined at its lower edge to the outer edge of the upper bracket plate. The vertical retainer plate is used to secure an additional insulation panel to the top of the bracket. When the chassis section is an I-beam, the additional insulation panel will be positioned between the top of the bracket and the underside of the upper horizontal member of the I-beam. The chassis bracket is preferably constructed of galvanized steel having a thickness of from 0.010 to about 0.095 inch.

The insulation panel can also be supported by unique spool brackets attached to the underside of the floor panels. Each spool bracket is comprised of an attachment plate to join the bracket to the panel, an insulation support plate to support the insulation panel, and a connecting member joining the attachment and support plates. The spool bracket can also include a locking plate positioned intermediate the attachment and support plates to secure the insulation panel in place.

The spool bracket can be in two sections, with the attachment and locking plates comprising part of an upper section, and the support plate being part of a lower section. The connecting shaft is comprised of an upper connecting shaft and a lower connecting shaft constructed so that the upper end of the lower connecting shaft can be attached to the lower end of the upper connecting member. When used, the upper surface of the attachment plate is secured to the lower surface of a floor panel, e.g., with double-sided adhesive tape. The connecting member of the lower section is then inserted through the insulation panel and attached to the upper section of the spool bracket.

Tie down brackets can be attached to the chassis. A unique form of tie down bracket is comprised of a mounting plate having a mounting surface on one side and an attachment eye on the other side of the plate. The mounting surface can be secured to the chassis, preferably the inner surface of the vertical member of an I-beam, with double-sided tape of the type previously described. The eye can be in the form of a horizontal "U" with the ends of the "U" joined to the mounting plate. In use, a chain, steel band, or other connecting member extends through the bracket eye to a ground anchor.

The structure of the invention can include other features. For example, conductive members, e.g., conductive tape, can be attached across the skins of adjacent panel members, so that grounding of one panel will ground all other panels. Also, tape paint or other protective coating material can be used to cover the outer surfaces of the floor panel frame members.

These and other aspects of the present invention will become apparent to those skilled in the art after a reading of the following description of the preferred embodiment taken together with the drawings.

DETAILED DESCRIPTION OF THE INVENTION

Figure 1:
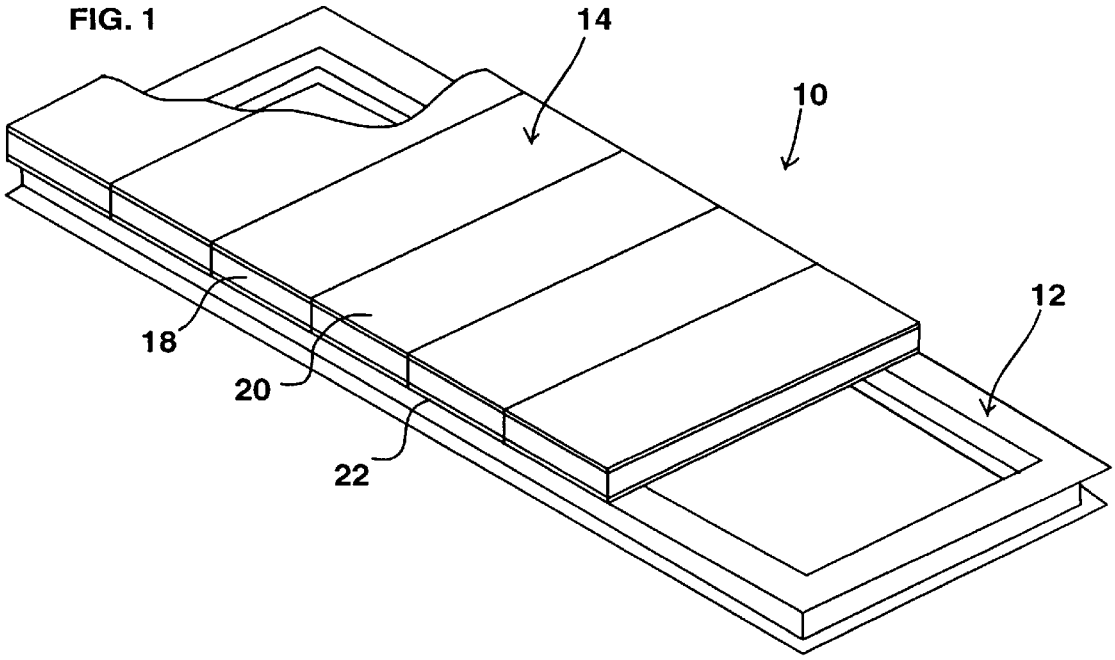
FIG. 1 is a perspective, sectional view of the floor structure of the invention showing a plurality of composite panels secured to the chassis. A section of two panels, and two complete panels are omitted for purposes of illustration.
Figure 2:
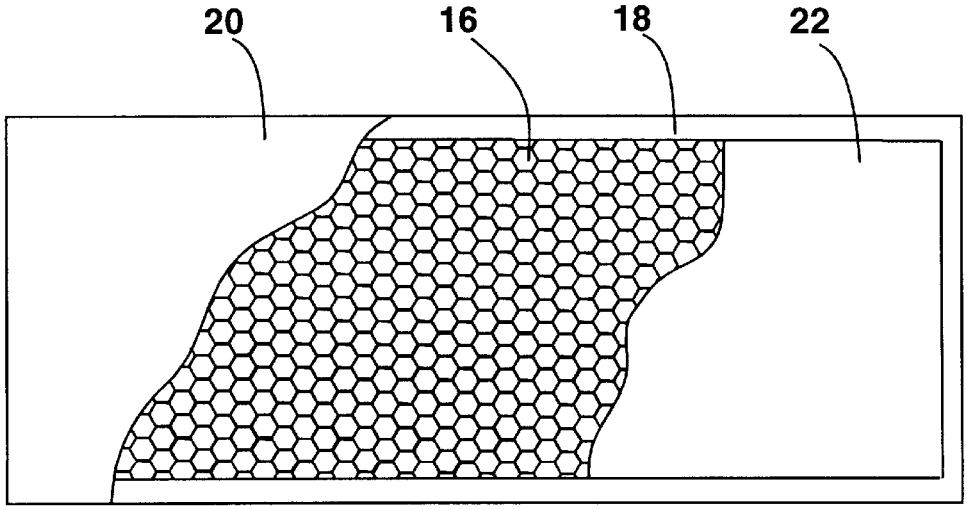
FIG. 2 is a top sectional view of a composite panel, showing the various components.
Figure 3:
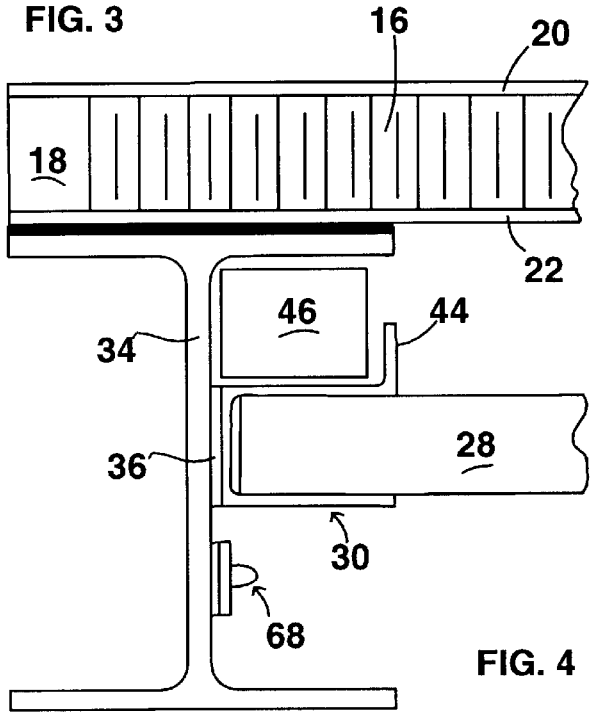
FIG. 3 is a sectional side view of the floor structure, showing an I-beam and composite floor panel, with an insulation panels attached below the composite panel with a chassis bracket. A ground anchor bracket is also shown attached to the I-beam.
Figure 4:
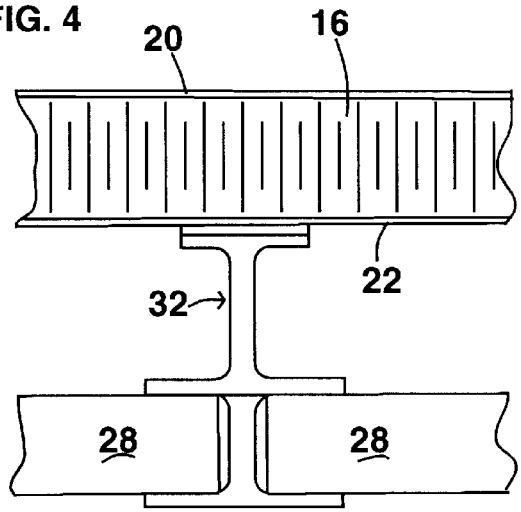
FIG. 4 is a sectional side view of a composite panel, with an insulation panel supported by a spool bracket attached to the lower surface of the composite panel.
Figure 5:
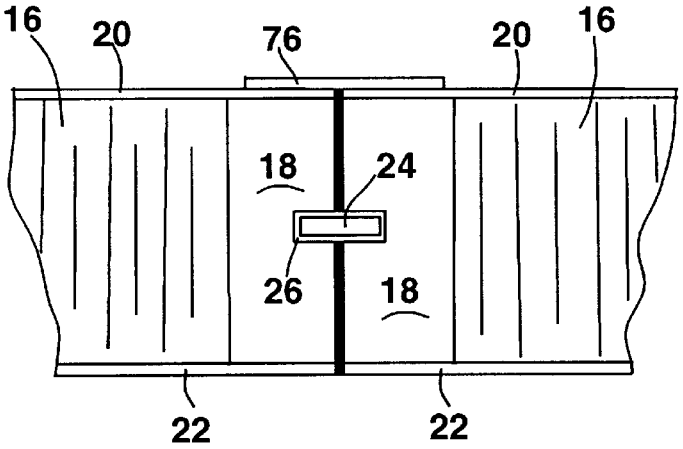
FIG. 5 is a sectional side view of two abutting composite panels with an intermediate spline. A conductive tape also joins the upper skins of the panels.
Figure 6:
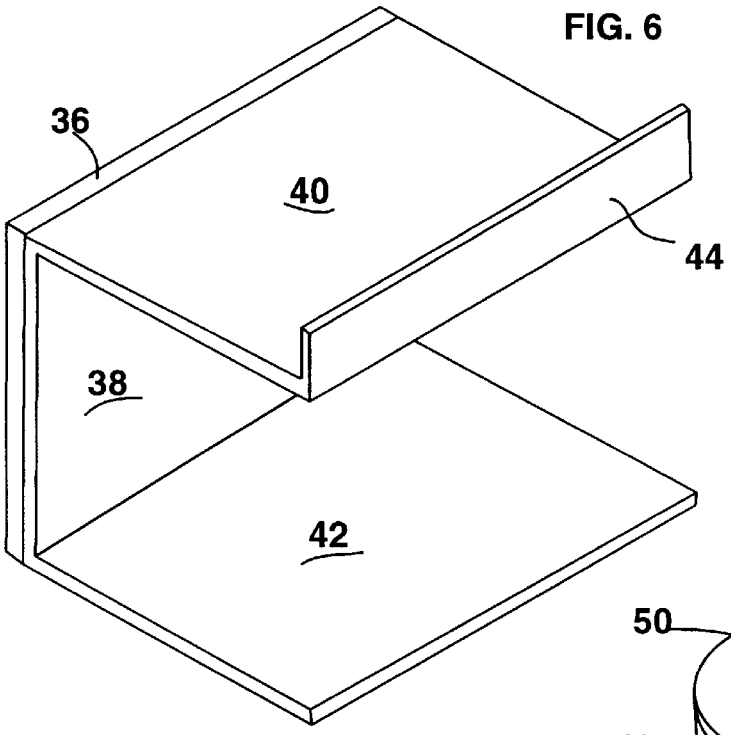
FIG. 6 is a perspective view of a chassis bracket used to secure an insulation panel to an I-beam.
Figure 7:
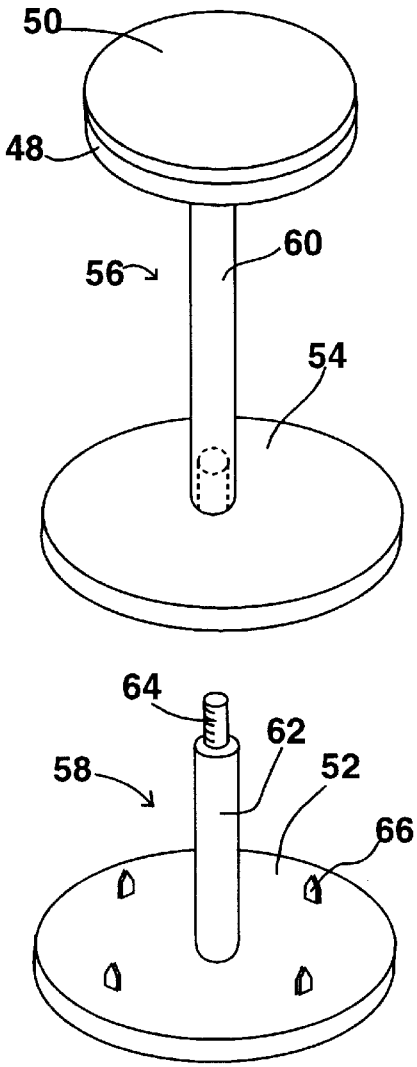
FIG. 7 is a perspective, exploded view of a spool bracket used to secure an insulation panel beneath a composite panel.
Figure 8:
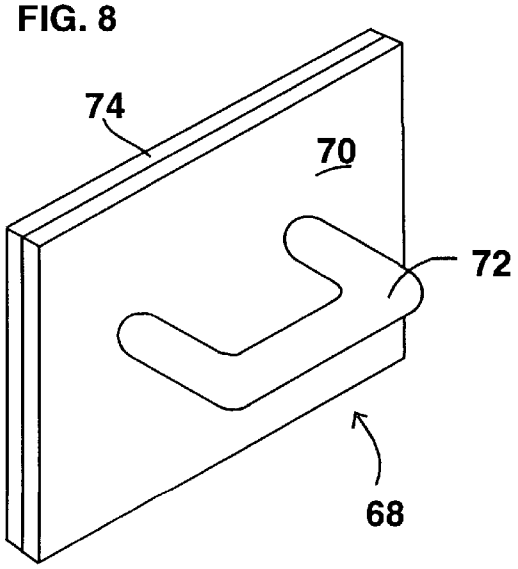
FIG. 8 is a perspective view of a ground anchor bracket.

In the following description, terms such as horizontal, upright, vertical, above, below, beneath, and the like, are used solely for the purpose of clarity in illustrating the invention, and should not be taken as words of limitation. It should also be recognized that the drawing are for purposes of illustrating the invention, and are not intended to be to scale.

As best shown in FIG. 1, the floor structure, generally 10, of the present invention is comprised of a chassis, or support frame, generally 12, constructed of steel I-beams having horizontal upper surfaces lying in a horizontal plane, forming a panel attachment surface, and a plurality of adjacent, composite, structural floor panels, generally 14. secured to the upper surface of the chassis 12, and to adjacent panels.

Each floor panel 14 is comprised of a rectangular honeycomb core 16, a frame or closeout 18 surrounding the periphery of honeycomb core 16, and upper and lower skins 20 and 22, respectively, across the opposed faces of honeycomb core 16. Honeycomb core 16 is comprised of adjacent strips of resin impregnated, kraft paper joined at discrete areas and expanded to form a plurality of hexagonal openings. Core 16 has a thickness of 3.94 inches, a width of 3 feet and 10 inches, and a length of 13 feet and 10 inches. The inner dimensions of frame 18 surrounding core 16 correspond to the outer periphery of core 16, to hold panel 16 into frame 18. Frame 18 is formed of four sections of fabricated wood having a thickness of 1 inch. Skins 20 and 22 are formed of full hard steel having a thickness of 0.30 inch, resulting in a panel having a thickness of 4 inches. The skins are galvanized to reduce rusting, and acid etched to enhance adhesive bonding.

In forming composite panel 14, the sections of frame 18 are joined at their ends, to form an open rectangle, and core 16 is inserted into the frame opening. The upper and lower surfaces of frame 18 and core 16 are coated with a water-based, urethane adhesive by passing frame 18 and core 16 between coating rollers. Skins 20 and 22 are then positioned over opposite faces of honeycomb core 16 and frame 18, and are secured in place with the adhesive.

Chassis 12 is formed of a plurality of steel I-beam sections, together forming a horizontal surface to which panels 14 and other components of the structure are joined. The upper surface of steel chassis 12 and adjacent surfaces of lower skins 22 of a plurality of panels 14 are wiped with alcohol and a plurality of adjacent panels 14 are secured to the upper surface of the chassis with an epoxy adhesive. Adjacent edges of panels 14 are secured to each other with CX-80, a flexible adhesive manufactured by Chemrex Corporation, to allow expansion and contraction without affecting the steel skins.

To improve the strength of the floor structure, longitudinal channels are formed between adjacent panels 14, by routing slots into the outer surfaces of the side sections of frame 18. These slots, when the panels are joined, form a channel 26 into which a spline or key 24 formed of cold rolled steel, and having a thickness of one-forth inch, a width of 1 inch and a length equal to the distance between side frame members 18. Spline 24 imparts additional rigidity to frame 18. Abutting faces of adjacent frames 18 are held together with the adhesive noted above.

Floor structure 10 also include insulation panels 28 positioned horizontally beneath, and parallel to, panels 14. The upper surface of panels 28 is spaced 2 inches beneath the lower surfaces of the floor panels 14 to form an air space that can also be used to run utility piping, cables, etc., to various parts of the structure. Insulation panels 28 are of rigid polyurethane foam.

Insulation panels 28 are secured to chassis 12 with chassis brackets 30, and to floor panels 14 with spool brackets 32. Chassis brackets 30 are preferably secured to the inside of vertical member 34 of an I-beam forming a part of chassis 12 with double-sided tape 36.

Chassis bracket 30, constructed of 0.025 gauge galvanized steel, is comprised of a vertical member 38 having spaced upper and lower retainer plates 40 and 42, respectively, extending horizontally from the upper and lower edges of vertical member 38, toward the interior of structure 10. Plates 40 and 42 are parallel and spaced apart a distance of approximately 2 inches, or the thickness of the insulation panel. Chassis bracket 30 also includes a vertical upright member or retainer plate 44 integral at its lower edge with the outer edge of upper plate 40. Plate 44 holds an additional insulation panel 46 onto the top of bracket 30.

Insulation panel 28 is also supported by spool brackets 32 attached to the underside of floor panel 14. Each spool bracket 32 is comprised of an attachment plate 48, double-sided adhesive tape 50 to join plate 48 to panel 14, an insulation support plate 52 to support insulation panel 28, a locking plate 54 positioned intermediate attachment plate 48 and support plate 52 to secure insulation panel 28 in place.

Spool bracket 32 is formed of two sections, with attachment plate 48 and locking plate 54 being part of an upper section 56, and support plate 52 being part of a lower section 58. Upper section 56 includes upper connecting shaft 60, and a lower section 58 includes lower connecting shaft 62. Shafts 60 and 62 are constructed so that the upper end of the lower connecting shaft 62 can be threaded into the lower end of the upper connecting shaft 60 at threaded connection 64. When positioning insulation panel 28, shaft 62 is inserted through insulation panel 28 and attached to upper shaft 60. Tabs or projections 66 extend upwardly from support plate 52 to secure insulation panel 28.

Chassis 12, when used as part of a structure like a mobile home, is secured with tie downs extending from the chassis to ground anchors screwed into the ground to prevent tipping of the structure in high winds. Normally, the tie down includes a cable or metal strip that is wrapped around the chassis. In the present invention tie down brackets, generally 68, comprised of a vertical mounting plate 70 with an attached U-shaped, horizontal eye 72 is secured to vertical section 34 of an I-beam of chassis 12 with double-sided tape 74. A chain, steel band, or other connecting member is threaded through eye 72 and down to a ground anchor, not shown. Strips of conductive copper tape 76 are attached across adjacent upper skins 20 of 14. As a result, all panels can be grounded by grounding only one of the panels.

Thus, the floor structure of the present invention is formed by the combination of a steel chassis and a plurality of composite panels secured to each other and to the chassis to form a rigid monocoque structure that is highly resistant to bending stresses. The panels, while constructed to provide rigidity and strength to the structure, are also light in weight.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A floor structure for a manufactured building comprising:

a) a steel frame having a horizontal upper surface; and b) a plurality of adjacent composite floor panels secured to the upper surface of said frame, said panels having a honeycomb core, a closeout around said core, said core and closeout having the same thickness, and upper and lower parallel steel skins on opposed surfaces of said core and said closeout, said lower skin being secured to said frame.

2. The floor structure of claim 1, wherein said honeycomb core is formed of resin impregnated kraft paper.

3. The floor structure of claim 1, wherein said panel skins are formed of full hard steel.

4. The floor structure of claim 1, further including insulation panels supported beneath said floor panels.

5. The floor structure of claim 1, further including ground anchor brackets secured to said steel frame.

6. The floor structure of claim 1, wherein said floor panels are secured to the upper surface of said steel frame with an epoxy adhesive.

7. The floor structure of claim 1, including splines connecting adjacent floor panels.

8. The floor structure of claim 1, wherein adjacent floor panels are joined with a flexible adhesive.

9. The floor structure of claim 4, further including brackets attached to said steel frame to support said insulation panels.

10. A composite panel for use in constructing the floor of a modular building comprising:

a) a honeycomb core having opposed faces and a continuous outer periphery;

b) a closeout surrounding the periphery of said honeycomb core, said closeout and said honeycomb core being of equal thickness; and c) steel skins secured across the opposed faces of said core and said closeout.

11. The panel of claim 10, wherein said honeycomb core is formed of resin impregnated kraft paper.

12. The panel of claim 10, wherein said honeycomb core is rectangular.

13. The panel of claim 10, wherein said closeout is formed of fabricated wood.

14. The panel of claim 10, wherein said steel skins are formed of full hard steel.

15. The panel of claim 10, wherein said steel skins are secured to said closeout with an adhesive.

16. The panel of claim 11, wherein said honeycomb panel has a thickness of from about 1 to about 10 inches.

17. The panel of claim 10, wherein said steel skins have a thickness of from about 0.010 to about 0.095 inch.

18. A floor structure for a manufactured building comprising:

a) a steel chassis having a horizontal upper surface;

b) a plurality of adjacent composite floor panels secured to the chassis upper surface, each panel including a honeycomb inner section having opposed faces and a continuous outer periphery, a frame surrounding the periphery of said honeycomb section; and steel skins secured to said frame across opposed faces of said panel; and c) foam insulation panels supported beneath said floor panels and separated from said floor panels by an air space.

19. The floor structure of claim 18, further including brackets attached to said chassis to support said insulation panels.

20. The floor structure of claim 18, further including ground anchor brackets secured to said chassis.

21. The floor structure of claim 10, wherein said closeout is comprised of side sections having outer faces, the faces of abutting panels having opposed longitudinal slots forming a longitudinal channel, said structure further include splines positioned in said channels.

22. A floor structure for a manufactured building comprising:

a) a rectangular, open steel chassis having a horizontal upper surface;

b) a plurality of adjacent composite floor panels secured to the chassis upper surface, each panel including a honeycomb inner section having opposed faces and a continuous outer periphery, a closeout surrounding the periphery of said honeycomb section; and parallel upper and lower steel skins secured across opposed faces of said core and said closeout, said lower skins being secured to said chassis; and c) foam insulation panels supported beneath said floor panels and separated from said floor panels by an air space.

23. The floor structure of claim 18, wherein said honeycomb core is constructed of resin impregnated paper.

24. The floor structure of claim 18, further including brackets joining said insulation panels to said floor panels.

25. The structure of claim 18, wherein said steel skins are formed of full hard steel and have a thickness of form about 0.010 to about 0.095 inch.

26. The structure of claim 18, wherein said panels have a thickness of from about 2 to about 6 inches.

* * * * *